US006519886B1

(12) United States Patent
Johnson et al.

(10) Patent No.: US 6,519,886 B1
(45) Date of Patent: Feb. 18, 2003

(54) SYSTEM AND METHOD FOR MOUNTING FRONT LOADED PHOTOGRAPHS

(75) Inventors: Thomas A. Johnson, Sandy Hook, CT (US); Scott Larsen, Newtown, CT (US)

(73) Assignee: Wet Puppy Products, LLC, Sandy Hook, CT (US)

( * ) Notice: Subject to any disclaimer, the term of this patent is extended or adjusted under 35 U.S.C. 154(b) by 43 days.

(21) Appl. No.: 09/655,650

(22) Filed: Sep. 5, 2000

(51) Int. Cl.[7] ..... A47G 1/06

(52) U.S. Cl. ..... 40/790; 40/718; 40/739; 40/740; 40/792

(58) Field of Search ..... 40/718, 739, 740, 40/790, 792, 156

(56) References Cited

U.S. PATENT DOCUMENTS

| | | | | | |
|---|---|---|---|---|---|
| 197,738 | A | * | 12/1877 | Lippe | 40/732 |
| 565,778 | A | * | 8/1896 | Murphy | 40/324 |
| 765,873 | A | * | 7/1904 | Berry | 40/792 |
| 1,358,988 | A | * | 11/1920 | Rindsberger | 40/790 |
| 1,400,920 | A | * | 12/1921 | Stroud | 40/790 |
| 1,553,472 | A | | 9/1925 | Pevovarchuk | |
| 1,600,658 | A | * | 9/1926 | Weil | 40/324 |
| 1,836,035 | A | | 12/1931 | Matys | |
| 1,882,157 | A | | 10/1932 | Minton | |
| 3,220,132 | A | * | 11/1965 | Swiger et al. | 40/711 |
| 3,408,759 | A | * | 11/1968 | Rotheraine et al. | 40/732 |
| 3,445,151 | A | * | 5/1969 | Stefanakis | 359/514 |
| 3,557,478 | A | * | 1/1971 | Sitzberger | 40/1.5 |
| 3,579,886 | A | | 5/1971 | Hughes | |
| 3,813,799 | A | | 6/1974 | Caravello | |
| 4,030,220 | A | | 6/1977 | Kotchen | |
| 4,117,613 | A | | 10/1978 | Hosker | |
| 4,271,619 | A | | 6/1981 | Schmidt | |
| 4,399,910 | A | * | 8/1983 | Gutentag | 206/0.82 |
| 4,553,344 | A | | 11/1985 | Rubin et al. | |
| 4,750,282 | A | | 6/1988 | Zennedjian | |
| 4,939,858 | A | | 7/1990 | Dailey | |
| 5,075,991 | A | | 12/1991 | Wenkman et al. | |
| 5,125,175 | A | * | 6/1992 | Huff, Jr. | 40/718 |
| 5,659,990 | A | * | 8/1997 | Henneman et al. | 40/795 |
| 5,974,714 | A | * | 11/1999 | Jones | 40/768 |

* cited by examiner

*Primary Examiner*—J. J. Swann
*Assistant Examiner*—Andrea Chop
(74) *Attorney, Agent, or Firm*—William C. Crutcher

(57) ABSTRACT

System and method for mounting front-loaded photographs, which are held in place in a recess with a smooth curvilinear sidewall by a flexible plastic retaining ring, which is precisely formed to frictionally engage the smooth sidewall. A variety of recess shapes and decorative retaining rings are useable to provide a variety of displays, either single or in an array. The preferred method of forming the recess is by routing, using a template set or computer-controlled router bit.

16 Claims, 8 Drawing Sheets

Figure 3:
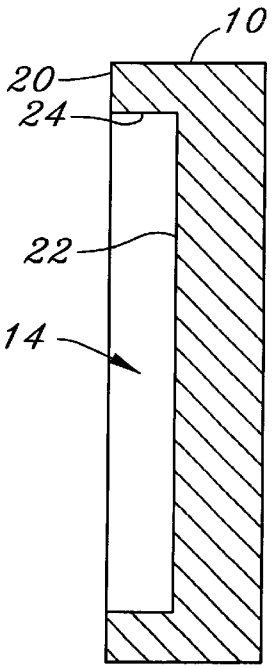

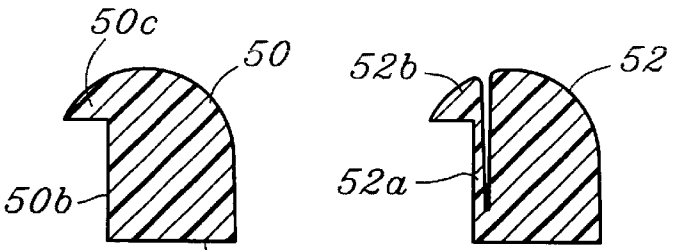
Fig.8
Fig.9
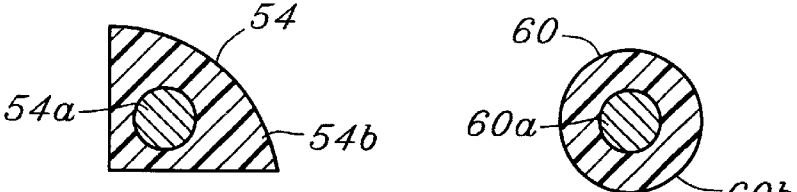
Fig.11
Fig.12
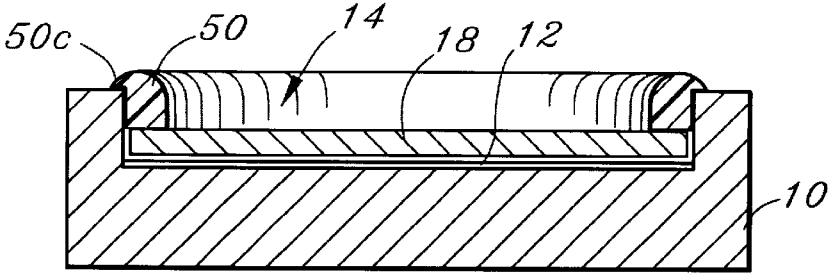
Fig.10
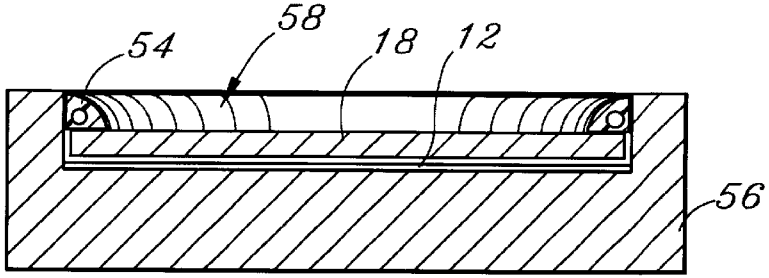
Fig.13

SYSTEM AND METHOD FOR MOUNTING FRONT LOADED PHOTOGRAPHS

This invention relates to a system for mounting photographs and the like, and more particularly to a system and method for mounting front loaded photographs or other thin flat items into recesses in the surface of a piece of wood or other solid substrate. It also relates to a method to create special shapes for the mounting recesses, such as circles, ovals, hearts and rectangles. This system is particularly useful for providing multiple shapes for displaying photographs in linear substrates, such wood trim or molding.

BACKGROUND OF THE INVENTION

While many systems and techniques are available for mounting photographs or other thin flat items from the back side of a frame, in order to display the items under a glass or plastic photograph protector, there are many times when it is desired to recess and retain the photographs from the front side of the mounting structure. This is particularly the case where the back of the mounting structure is inaccessible or inconvenient to reach. For example, it may be desirable to recess and retain a photograph in a piece of a polished wood of considerable thickness, or in a desktop or molding where only the front surface is accessible.

A number of prior art systems are known for mounting photographs and the like from the front side of a recess or picture frame. These known systems usually require that the recess include a groove in the sidewall, or a flanged retaining frame with the flange overhanging the perimeter of the recess, or rectangular inner frames which are press fit into the recess. For example, U.S. Pat. No. 1,836,035-Matys shows a front-loaded coin and picture frame, in which coins or photographs are held in a recess by means of an expanding circular spring ring fitting in a groove in the sidewall. There currently exists a round plastic photograph frame insert assembly that holds a photograph in a round recess. It uses a flanged retaining ring design, whereby the flange overhangs the perimeter of the recess, and the photograph is held inside the insert by separate backing piece that snaps into the insert. This complete assembly is then pressed into the recess. Molded tabs on the perimeter of the insert ring press against the sidewall of the recess to hold it in place.

U.S. Pat. No. 4,939,858 issued Jul. 10, 1990 to Dailey shows (FIG. 3) a rectangular inner clamping frame of plastic which frictionally engages the edges of an outer recess holding a photograph with rectangular dimensions loaded from the front. The inner rectangular clamping frame is dimensioned to be held frictionally in place within a recess with planar sidewalls.

Other front loaded frames with mounting members providing frictional engagement within a recess are disclosed in the following patents, which are exemplary of the prior art.

| Patent No. | Issue Date | Inventor |
|---|---|---|
| 4,030,220 | June 21, 1977 | Kotchen |
| 3,579,886 | May 25, 1971 | Hughes |
| 1,882,157 | October 11, 1932 | Minton |
| 5,075,991 | December 31, 1991 | Wenkman et al. |
| 4,271,619 | June 9, 1981 | Schmidt |
| 4,750,282 | June 14, 1988 | Zennedjian |

Front loading systems for mounting photographs and the like are often utilized to provide multiple photograph displays. Systems for multiple picture displays utilizing various mounting systems are disclosed in the following patents, which are exemplary of the prior art.

| Patent No. | Issue Date | Inventor |
|---|---|---|
| 4,553,344 | November 19, 1985 | Rubin, et al |
| 4,117,613 | October 3, 1978 | Hosker |
| 3,813,799 | June 4, 1974 | Caravello |
| 1,553,472 | September 15, 1925 | Pevovarchuk |

It would be desirable to have a simple system for mounting photographs from the front in wood or similar substrate materials. It would also be desirable to have a simple system for providing a recess of a particular shape from the front of the substrate, combined with a simple system for retaining a photograph in the recess.

It would also be desirable to have a system and method for providing multiple front-loaded photographs in a wood base or molding.

Accordingly, one object of the present invention is to provide an improved system and method for mounting front-loaded photographs and similar thin objects.

Another object of the invention is to provide an improved method for mounting and displaying photographs in a wood substrate.

Another object of the invention is to provide a system and method for mounting multiple photographs in the front surface of a substrate.

SUMMARY OF THE INVENTION

Briefly stated the invention comprises a method and system for mounting and retaining front loaded photographs, comprising a substrate having a planar front surface defining at least one recess therein, the recess having a planar bottom surface and having a smooth sidewall joining the planar surfaces, which sidewall defines a continuous curvilinear periphery of the recess having a first peripheral outline and a first peripheral dimension; a transparent protective cover adapted to hold a photograph against the planar bottom surface with a curvilinear periphery arranged to fit inside the recess; and a flexible retaining ring of substantially uniform cross section having a periphery with a second peripheral dimension substantially the same as the first peripheral dimension of the recess, the flexible retaining ring being disposed in the recess so as to assume the first peripheral outline and to hold the protective cover in place by frictional engagement with the smooth sidewall of the recess.

In its preferred embodiment the substrate is wood and the retaining ring is plastic. Curvilinear shapes may be circular, elliptical, heart-shaped, or rectangular with filleted corners. The term "curvilinear" is defined herein to include straight lines joined by curved lines, but to exclude straight lines intersecting with one another. Multiple display recesses are easily produced in wooden substrates, or in lengths of molding or trim for easily loading multiple photographs from the front side.

DRAWINGS

Figure 2:
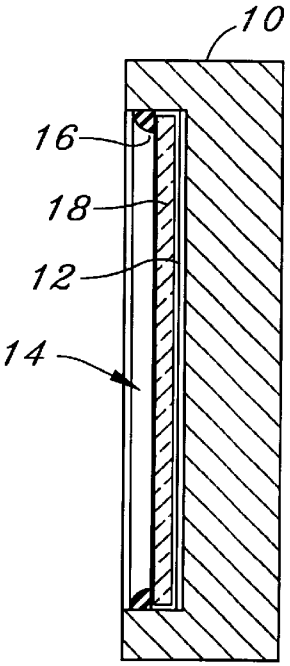
Figure 1:
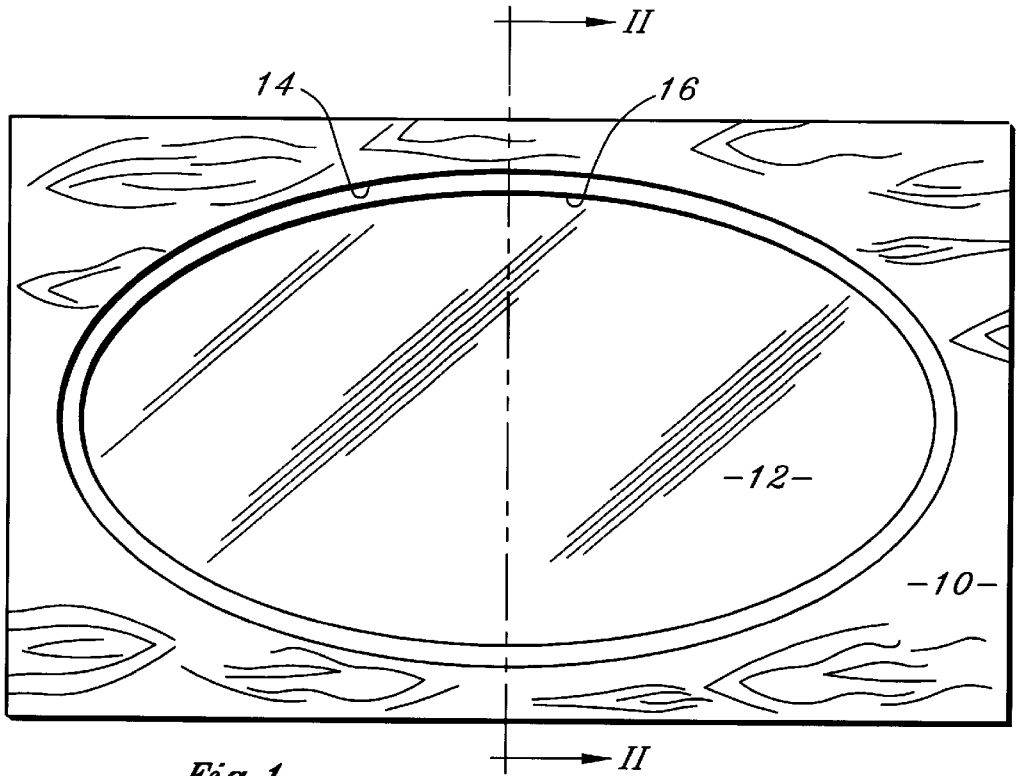
Figures 4A, 4B, 4C:
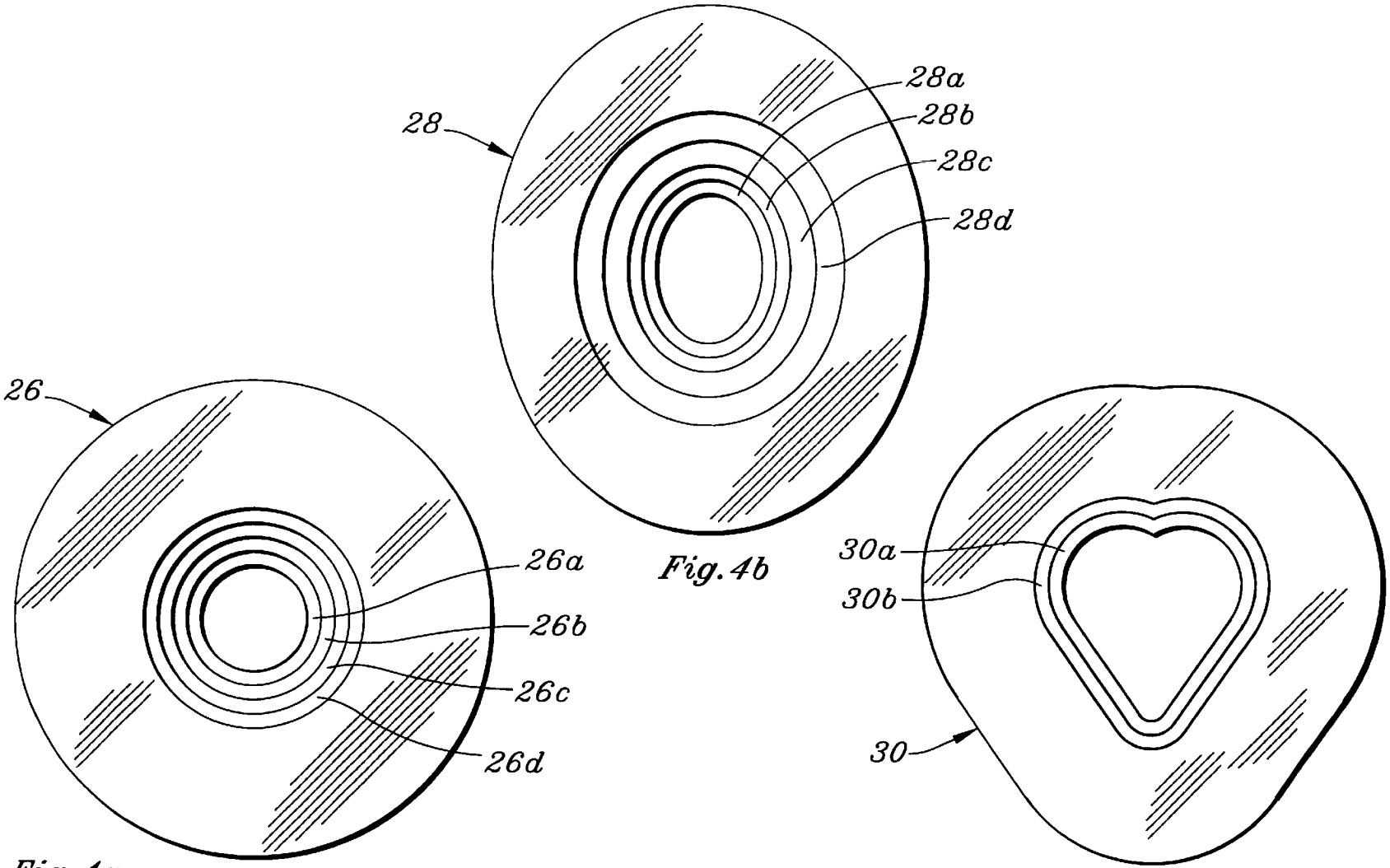
Figure 5:
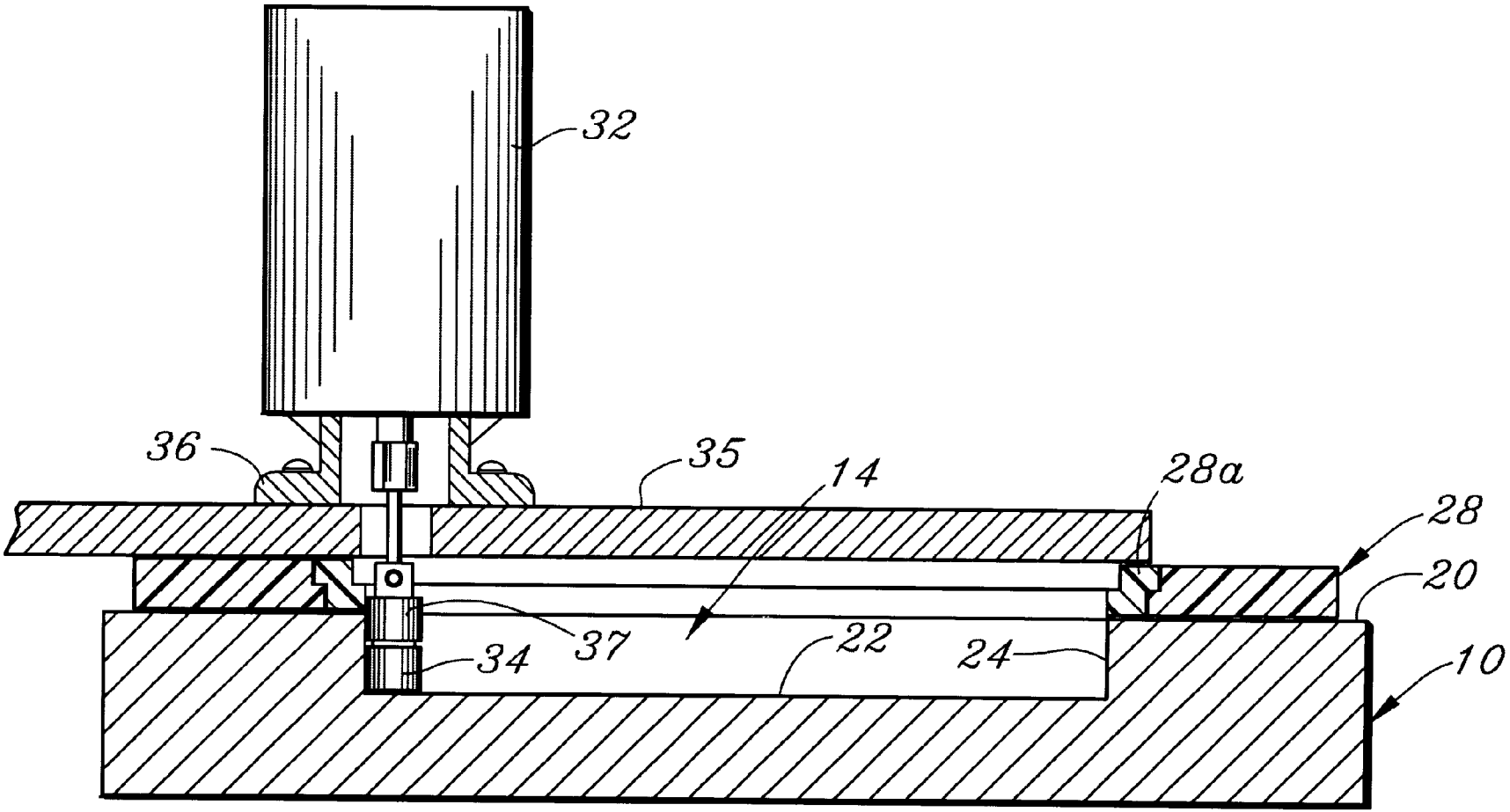

The invention will be more clearly understood by reference to the following description, taken in connection with the accompanying drawings, in which:

FIG. 1 is a plan view of a single front-loaded photograph in a wooden mounting or substrate, FIG. 2 is an end elevational view, in cross section, taken along lines II—II of FIG. 1, FIG. 3 is the same cross sectional view as FIG. 2, but without the photograph, protective cover and retaining ring, showing the recess in the substrate, FIGS. 4*a*, 4*b* and 4*c* are plan views illustrating nested templates utilized in the method of producing curvilinear recesses in the form of circles, ellipses, or hearts, respectively as used in the present invention, FIG. 5 is an end elevational view showing the method of producing the recessed substrate of FIG. 3, using the templates of FIG. 4*b,*

FIGS. 6*a* through 6*g* are plan views of a variety of shapes of molded plastic retaining rings to be utilized with matching recesses, FIGS. 7*a* through 7*e* are enlarged elevational views in cross section of a variety of molded plastic retaining rings useable for any of the retaining rings depicted in FIGS. 6*a* through 6*g,*

Figure 14:
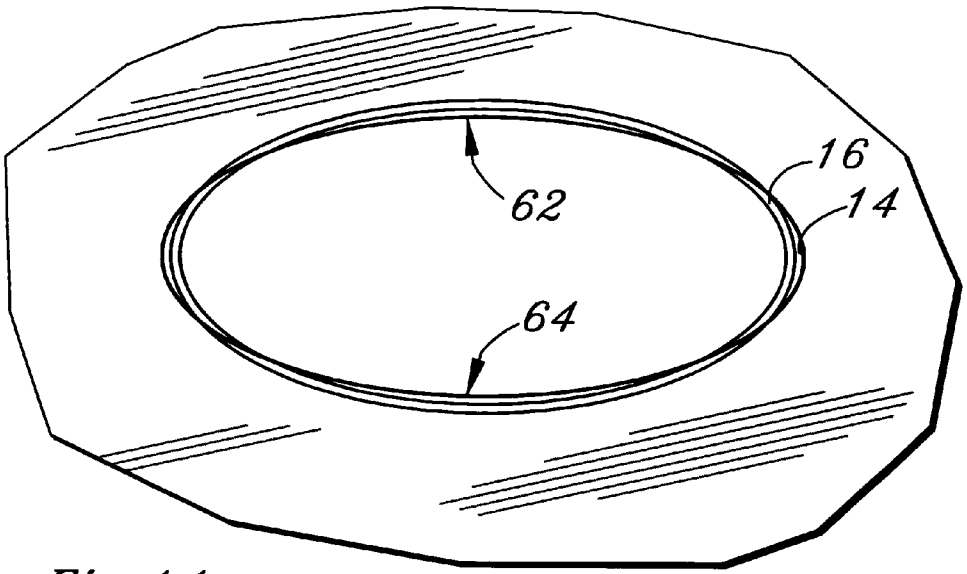
Figure 15:
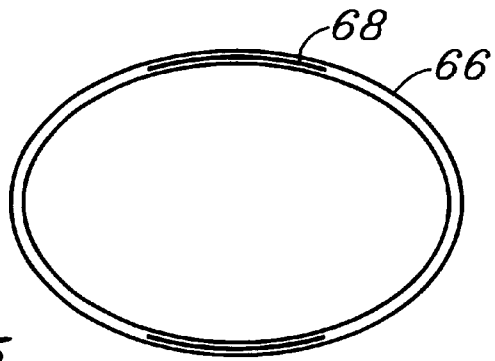
Figure 16:
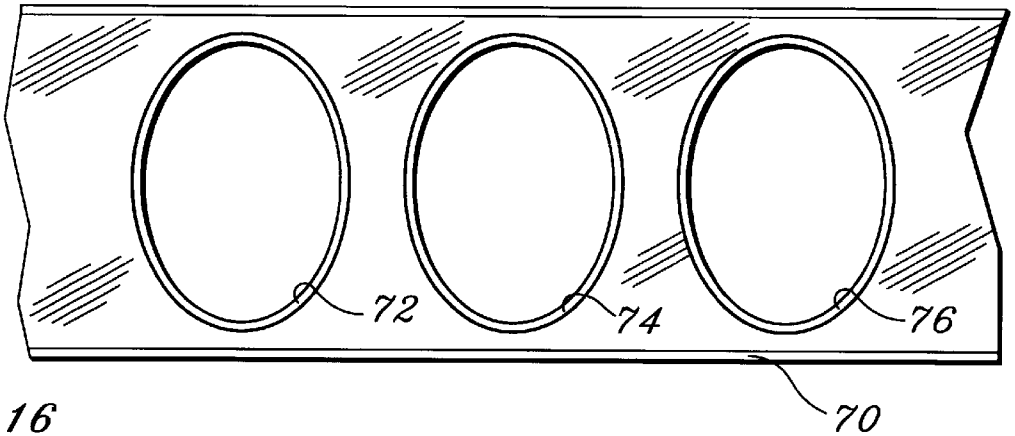
Figure 17:
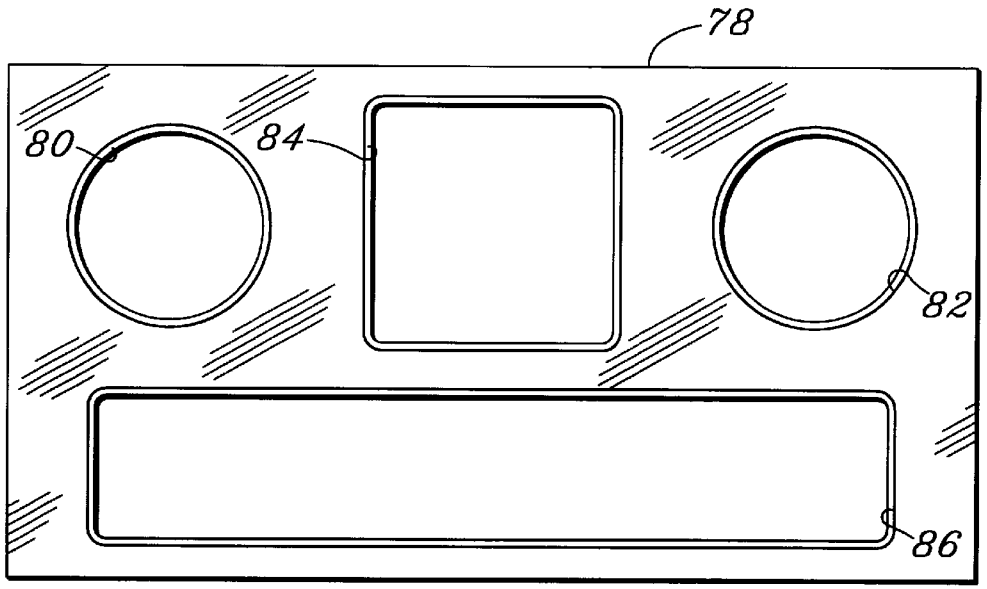

FIGS. 8 and 9 are enlarged cross sectional views similar to FIG. 7, illustrating alternate forms of retaining rings having external flanges, FIG. 10 is an end elevational view, in cross section, of a photograph mounted in a wood substrate using the retaining ring depicted in FIG. 8, FIGS. 11 and 12 are enlarged cross sectional views of composite retaining rings having metal cores, FIG. 13 is an end elevational view of a plastic substrate, taken in cross section, utilizing a retaining ring as depicted in FIG. 11, FIG. 14 is a plan view of a portion of a substrate with elliptical recess indicating a retaining ring of a slightly different elliptical shape, FIG. 15 is a bottom plan view of a modified retaining ring, FIG. 16 is a plan view of a linear section of wood molding with multiple spaced photographs, and FIG. 17 is a plan view of a large substrate with an array of photographs of multiple shapes mounted and retained according to the present invention.

DESCRIPTION OF THE PREFERRED EMBODIMENT

Referring to FIG. 1 of the drawing, a wooden substrate 10 serves as a frame for mounting a photo 12 within an elliptical recess 14. The photograph and its protective cover are retained in recess 14 by an elliptical retaining ring 16. The wood substrate 10 may be of any thickness greater than the depth of recess 14, since the photograph 12 is mounted from the front. The substrate 10 may include a suitable bracket, stand or hanging cord (not shown) which is not material to the present invention. Substrate 10 may also be part of a larger structure such as a desk top, panel, door, trim or molding.

Referring to FIG. 2 of the drawing, the cross section shows photograph 12 in the bottom of the recess to be covered by a transparent protective cover 18 of plastic or glass, and held in place by retaining ring 16 making frictional engagement with the smooth sidewall of recess 14. Retaining ring 16 is a continuous ring of flexible molded plastic material having a precise peripheral dimension matching the peripheral dimension of recess 14. Retaining ring 16 is preferably selected to be of a cross sectional dimension so that the combined height of the flexible retaining ring, protective cover and photograph are less than the height of the recess sidewall.

Reference to FIG. 3 of the drawing illustrates the substrate 10 as formed with the recess 14 in accordance with the present invention. Substrate 10 has a planar front surface 20 into which recess 14 is formed from the front. The recess has a planar bottom surface 22 and a smooth sidewall 24 joining the planar surfaces. Sidewall 24 encircles the recess to define a continuous curvilinear periphery with a peripheral outline or shape, such as a circle, ellipse, heart-shape, polygon, or rectangle with filleted corners. In contrast to the prior art, the sidewall 24 is smooth and devoid of indentations or grooves, such as those used to retain prior art "O-ring" retainers.

A preferred method of forming the recess 14 from the front of the substrate is to use a router tool with a top mounted bearing on a flush trimming bit guided by a curvilinear template. FIG. 4*a*, 4*b* and 4*c* show three template sets of nested templates. Each set defines a selected shape. FIG. 4*a* illustrates a template set 26 of circular templates 26*a*–26*d* of decreasing peripheral dimension. The nested templates are retained by adjacent templates through suitable interlocking means which are not material to the present invention, and may be successively removed to enlarge the peripheral dimension of the opening.

In a similar manner, the set of nested templates of elliptical shape is indicated at reference number 28 having nested removable templates 28*a*–28*d* of decreasing peripheral dimension.

The heart-shaped set 30 shown in FIG. 4*c* includes nested templates 30*a*, 30*b*.

Reference to FIG. 5 of the drawing illustrates a router tool in the process of forming a curvilinear recess as in FIG. 3. A template set 28 of elliptical shape, holding a template 28*a* defining a peripheral dimension of the ellipse, serves to guide a routing tool to form the recess. The router is illustrated as a hand operated router 32 having a router bit 34. A flat guide plate 35 attached to router 32 by brackets 36 rests on the template set 28 to establish depth of the recess 14. A ball bearing 37 guided by template 28*a* and the sidewall 24 of the recess enables the router operator to precisely form a curvilinear recess with a planar bottom surface, and a smooth sidewall having a first peripheral outline and a first peripheral dimension. The minimum curvature is determined by the cutting radius of the router bit. Such a bit provides filleted corners for rectangular or polygonal recesses.

Alternatively, a computer controlled machine with a router bit may be employed to provide recesses 14. In the case of using a computer controlled router, no templates are necessary.

Figure 6A:
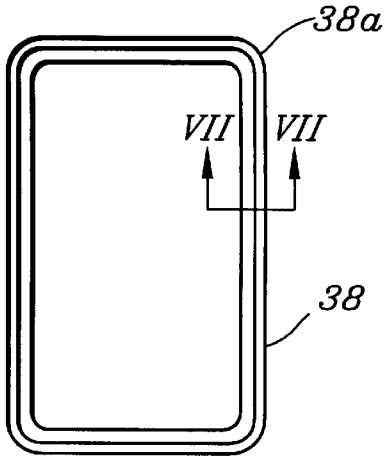
Figure 6B:
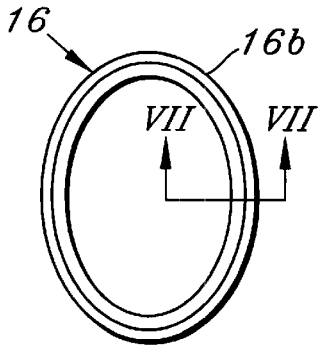

FIG. 6*a* through 6*g* illustrates a variety of retaining rings, which may be used in the present invention. The preferred retaining rings are made of flexible plastic and may have any of the typical cross sections illustrated in FIGS. 7*a* through 7*e*. The retaining ring 16, having a cross section taken through lines VII—VII and illustrated in FIG. 7*b*, may be taken as exemplary of common characteristics described as follows. Retaining ring 16 has a flat underside 16*a*, which contacts and retains the protective cover of the photograph, and a flat sidewall 16*b*, which contacts and frictionally engages the smooth sidewall of the recess. Referring to FIG. 6*b* of the drawing, retaining ring 16 has a substantially uniform cross section and a periphery defined by the wall 16*b*. Ring 16 has a peripheral dimension selected to be substantially the same as the peripheral dimension of the recess.

Figure 6C:
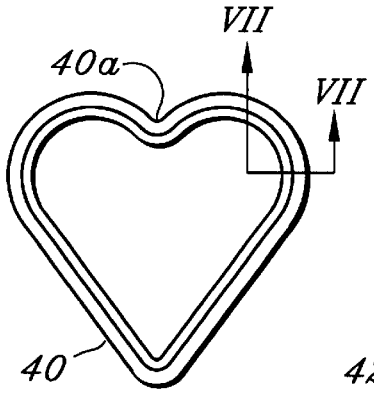
Figure 6D:
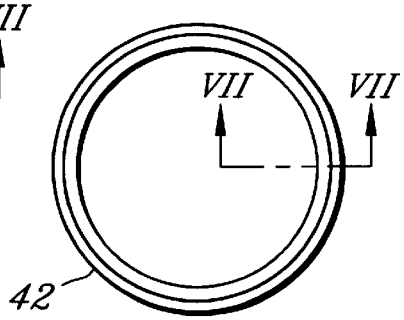
Figure 6E:
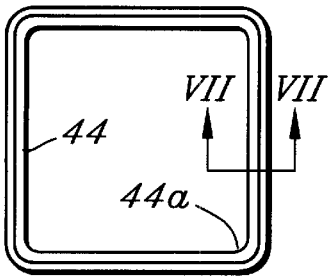
Figure 6F:
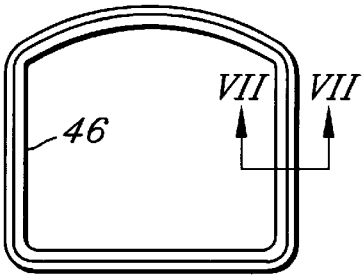
Figure 6G:
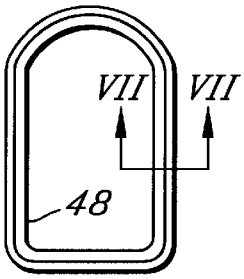
Figure 7A:
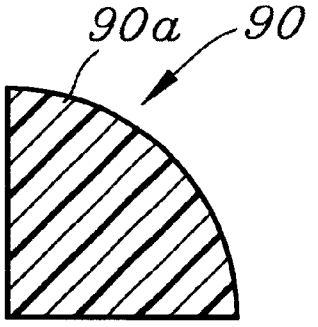
Figure 7B:
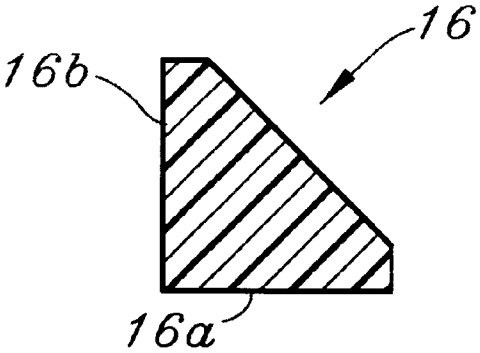
Figure 7C:
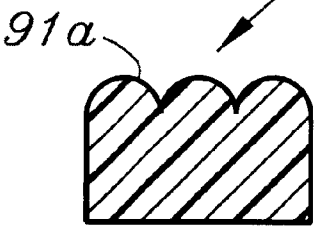
Figure 7D:
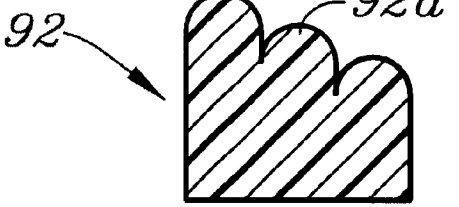
Figure 7E:
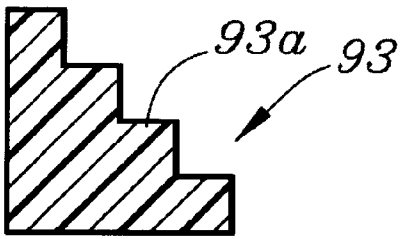

A variety of other retaining rings are shown. FIG. 6*a* depicts a retaining ring 38 having straight sides and filleted corners 38*a*. FIG. 6*c* shows a heart-shaped retaining ring 40 with a filleted reverse curve 40*a*. FIG. 6*d* is a circular retaining ring 42, and FIG. 6*e* is another rectangular retaining ring 44 with filleted corners 44*a*. Other shapes are possible to create selected mountings, such as retaining ring 46 with three straight sides and arched topside for landscape views, and retaining ring 48 of similar configuration, but dimensioned for vertically oriented photographs. Polygons (not illustrated) with any number of straight sides and provided with filleted corners at the intersections of the straight sides fall within the scope of the definition of "curvilinear" retaining rings and recesses.

A variety of retaining ring cross sections 90 through 93 are illustrated in FIGS. 7*a* through 7*e* respectively, which provide decorative exposed surfaces 90*a* through 93*a*, as apparent from the drawing.

Referring to FIGS. 8, 9 and 10 of the drawing, a modified form of the invention is illustrated. FIG. 8 shows a retaining ring 50 of flexible molded plastic having a bottom surface 50*a* arranged to contact the protective cover, a sidewall 50*b* defining the peripheral dimension of the retaining ring and designed to frictionally engage the recess sidewall. Ring 50 is provided with an overhanging flange 50*c*. Referring to FIG. 10 of the drawing, the arrangement is identical to that shown in FIG. 2, except that retaining ring FIG. 50 is substituted for retaining ring 16. The overhanging lip or flange 50*c* provides an enhanced decorative rim hiding the edge of the recess.

FIG. 9 of the drawing shows an alternate cross section for a retaining ring with a flange. A retaining ring 52 includes a peripheral web 52*a* supporting an overhanging lip 52*b*. Web 52*a* increases the ability of retaining ring 52 to maintain frictional engagement with the sidewall of the recess.

Other modifications of the invention are shown in FIGS. 11, 12 and 13. FIG. 11 illustrates the cross section of a retaining ring 54 with a composite construction comprising a core 54*a* of spring metal, over-molded with a flexible plastic exterior 54*b* in a shape previously described.

FIG. 13 illustrates the retaining ring 54 frictionally engaging the sidewall of the recess and holding the protective cover 18 and photograph 12 in the recess. In this case, however, the substrate comprises a plastic substrate 56 having a recess 58 of the same characteristics as previously described for recess 14, except that the recess 58 is molded into plastic substrate 56 at the time of manufacture.

FIG. 12 illustrates a retaining ring 60 with a spring metal core 60*a* covered with plastic tubing 60*b*.

Since the peripheral dimension of the recess and the peripheral dimension of the retaining ring are substantially the same, a preferred method to create frictional engagement with the sidewall is to manufacture the retaining rings so that the unconfined shape of the retaining ring is slightly different than the shape of the recess. Therefore, when the retaining ring is flexed to insert it, it tends to try to assume its unconfined shape and to press diametrically against the sidewalls of the recess. This is illustrated in FIG. 14 of the drawing. Retaining ring 16 is shown in its unconfined shape prior to insertion in the recess 14. Both ring 16 and ring 14 have the same peripheral dimension. However, they have different elliptical shapes, since the major axis of elliptical retaining ring 16 is less than the major axis of elliptical recess 14, and conversely the minor axis of retaining ring 16 is greater than the minor axis of elliptical recess 14. When retaining ring 16 is inserted, it will tend to assume its unconfined state and exert pressure on the sidewalls at points 62, 64.

An alternate means to obtain frictional engagement of the sidewalls is shown in FIG. 15. A retaining ring 66 is shown in bottom plan view to be provided with longitudinal slits 68. Spring metal inserts having a curvature different than that of the recess curvature are inserted into slits 68. This causes retaining ring 66 to exert pressure diametrically on the recess sidewalls to increase the frictional engagement.

The invention is especially adaptable to multiple photograph mounting. FIG. 16 illustrates a linear wooden molding and FIG. 17 an array of assorted shapes.

FIG. 16 shows a portion of a piece of wooden molding with a longitudinal dimension substantially exceeding its lateral dimension. Recesses 72, 74, 76 are longitudinally spaced along its longitudinal dimension. Other recesses (not shown) continue along a portion of molding 70 which are not seen in the drawing. The recesses are conveniently cut during mass production process so that the molding can be sold with recesses included. Plastic trim can also be used as a substrate with spaced recesses molded at the time of the trim.

FIG. 17 illustrates a frame 78 as the substrate formed with circular recesses 80, 82, square recess 84 and rectangular recess 86. The recesses 80, 82, 84 and 86 are of different shapes and arranged in a symmetrical array.

While there has been described what is considered to be the preferred embodiment of the invention and several modifications, it is desired to secure in the appended claims all such modifications as fall within the true spirit and scope of the invention.

What is claimed is:

1. A system for mounting thin flat items, comprising:

a substrate comprising a single unitary member having a front viewing surface defining at least one curvilinear recess therein, said recess having a closed planar bottom surface and having a smooth planar sidewall perpendicular to said closed planar surface, said sidewall defining a continuous curvilinear periphery of said recess having a first peripheral outline and a first peripheral dimension;

a transparent protective cover adapted to hold said thin flat item against said closed planar bottom surface, said protective cover disposed in said recess and having a curvilinear periphery arranged to fit closely inside said recess, and a flexible continuous retaining ring of substantially uniform cross section, the flexible retaining ring having a periphery with a second peripheral dimension substantially the same as the first peripheral dimension of the recess, said flexible retaining ring being disposed in the recess so as to assume the first peripheral outline and to engage said smooth planar sidewall all around the first peripheral outline so as to hold the protective cover in place by frictional engagement with the smooth sidewall of the recess.

2. The system according to claim 1, wherein said first peripheral outline is rectangular with filleted corners.

3. The system according to claim 1, wherein said first peripheral outline is heart-shaped with a centerline and having fillets on the centerline.

4. The system according to claim 1, wherein said first peripheral outline has three straight sides and a convex curved side, said sides being connected to filleted corners.

5. The system according to claim 1, wherein said first peripheral outline is a regular polygon having straight sides being connected to filleted corners.

6. The system according to claim 1, wherein said flexible retaining ring has a second peripheral outline when it is not confined in the recess, said second peripheral outline being different from the first peripheral outline so as to require flexing the retaining ring to insert it into the recess.

7. The system according to claim 1, wherein said flexible retaining ring defines at least one longitudinal slit, and having a spring metal insert disposed in said slit adapted to create frictional engagement of the retaining ring with the recess sidewall.

8. The system according to claim 1, wherein said flexible retaining ring has a cross section with substantially perpendicular side and bottom walls having side and bottom dimensions, the side wall of the retaining ring being frictionally engaged with the recess sidewall.

9. The system according to claim 8, wherein the combined thickness of the protective cover and the flexible retaining ring side wall dimension is less than the depth of said recess.

10. The system according to claim 8, wherein the combined thickness of the protective cover and the flexible retaining ring side wall dimension is greater than the depth of said recess, said retaining ring further including a peripheral flange extending radially outward beyond the recess sidewall to provide a decorative rim.

11. The system according to claim 1, wherein said flexible retaining ring comprises a flexible metal core disposed within a flexible plastic exterior.

12. The system according to claim 11, wherein said plastic exterior is molded around the metal core.

13. The system according to claim 11, wherein said plastic exterior comprises plastic tubing surrounding the metal core.

14. A method for mounting thin flat items, comprising the steps of:

providing a substrate comprising a single unitary member having a front viewing surface;

forming at least one curvilinear recess in the front viewing surface, said recess having a closed planar bottom surface and having a smooth planar sidewall perpendicular to said closed planar surface, said sidewall defining a continuous curvilinear periphery of said recess having a first peripheral outline and a first peripheral dimension;

providing a transparent protective cover adapted to hold said thin flat item against said closed planar bottom surface, said protective cover having a curvilinear periphery arranged to fit closely inside said recess;

inserting said protective cover into the recess;

providing a flexible continuous retaining ring of substantially uniform cross section, the flexible retaining ring having a periphery with a second peripheral dimension substantially the same as the first peripheral dimension of the recess;

inserting said flexible retaining ring in to the recess so as to assume the first peripheral outline and to engage said smooth planar sidewall all around the first peripheral outline so as to hold the protective cover in place by frictional engagement with the smooth sidewall of the recess.

15. The method according to claim 14, wherein the recess forming step comprises providing a template and routing out said recess to conform to the shape of said template.

16. The method according to claim 14, wherein the retaining ring is provided having a different shape than that of the recess, and including the step of deforming the retaining ring to assume the shape of the recess, before inserting it into the recess.

* * * * *